US011251529B2

(12) United States Patent
Desclos

(10) Patent No.: US 11,251,529 B2
(45) Date of Patent: Feb. 15, 2022

(54) LOW PROFILE ANTENNA MODULE

(71) Applicant: AVX Antenna, Inc., San Diego, CA (US)

(72) Inventor: Laurent Desclos, San Diego, CA (US)

(73) Assignee: AVX Antenna, Inc., San Diego, CA (US)

( * ) Notice: Subject to any disclaimer, the term of this patent is extended or adjusted under 35 U.S.C. 154(b) by 21 days.

(21) Appl. No.: 16/925,485

(22) Filed: Jul. 10, 2020

(65) Prior Publication Data

US 2020/0343639 A1 Oct. 29, 2020

Related U.S. Application Data

(63) Continuation of application No. 15/490,875, filed on Apr. 18, 2017, now Pat. No. 10,756,435.

(60) Provisional application No. 62/324,221, filed on Apr. 18, 2016.

(51) Int. Cl.

| | |
|---|---|
| ***H01Q 9/04*** | (2006.01) |
| ***H01Q 1/48*** | (2006.01) |
| ***H01Q 1/22*** | (2006.01) |

(52) U.S. Cl.

CPC ..... *H01Q 9/0407* (2013.01); *H01Q 1/2233* (2013.01); *H01Q 1/48* (2013.01)

(58) Field of Classification Search

CPC ..... H01Q 1/243; H01Q 1/26; H01Q 1/38; H01Q 9/0407; H01Q 9/0421

See application file for complete search history.

(56) References Cited

U.S. PATENT DOCUMENTS

| | | | | |
|---|---|---|---|---|
| 6,285,324 | B1 | 9/2001 | Korisch et al. | |
| 6,717,551 | B1 | 4/2004 | Desclos et al. | |
| 6,744,410 | B2 | 6/2004 | Shamblin et al. | |
| 6,906,667 | B1 | 6/2005 | Poilasne et al. | |
| 7,123,209 | B1 | 10/2006 | Desclos et al. | |
| 9,413,062 | B2 | 8/2016 | Ortiz | |
| 9,923,260 | B2 | 3/2018 | Desclos et al. | |
| 10,084,240 | B2 | 9/2018 | Shamblin et al. | |
| 2003/0201942 | A1 | 10/2003 | Poilasne et al. | |
| 2013/0285877 | A1* | 10/2013 | Desclos | H01Q 5/371 343/872 |
| 2016/0020648 | A1* | 1/2016 | Contopanagos | H01Q 19/10 307/104 |
| 2016/0294046 | A1* | 10/2016 | Hsieh | H01Q 9/42 |
| 2016/0365647 | A1* | 12/2016 | Du | H01Q 25/00 |

* cited by examiner

*Primary Examiner* — Daniel Munoz

(74) *Attorney, Agent, or Firm* — Dority & Manning, P.A.

(57) ABSTRACT

An antenna module is described where uniform radiation pattern coverage is provided in the plane of a low profile antenna radiating element. A polarization that is orthogonal to the plane of the low profile antenna radiating element can be achieved for the radiated field. A ground plate aperture is implemented into the antenna ground plate to minimize frequency shift as the antenna is installed on metallic (conductive) and non-metallic (non-conductive) ground planes of varying sizes. This antenna system technique is applicable for use in communication systems such as a local Area network (LAN), cellular communication network, and Machine to Machine (M2M).

20 Claims, 6 Drawing Sheets

LOW PROFILE ANTENNA MODULE

CROSS-REFERENCE TO RELATED APPLICATIONS

This application is a continuation of U.S. Ser. No. 15/490,875, filed Apr. 18, 2017, titled "LOW PROFILE ANTENNA MODULE", which claims the benefit of priority under 35 U.S.C. § 119(e) to U.S. Provisional Application No. 62/324,221, filed Apr. 18, 2016, titled "LOW PROFILE ANTENNA SYSTEM," the disclosures of which are hereby expressly incorporated by reference as part of the present application as if fully set forth herein.

BACKGROUND OF THE INVENTION

Field of the Invention

This invention relates generally to the field of wireless communication. In particular, the invention relates to an antenna module configured to provide low profile attributes with uniform radiation pattern coverage in the plane of the antenna radiating element associated with the module.

Description of the Related Art

A proliferation of wireless communication systems such as wireless wide area networks (WWANs) also referred to as "cellular systems", wireless local area networks (WLANs), machine to machine (M2M) systems, and Internet of things (IoT) applications, has increased the number and types of devices and infrastructure that antennas are, or will, need to be designed into and/or integrated with.

Some M2M applications can be demanding when a low profile antenna is required, specifically when the height allocated for the antenna is not sufficient for efficient operation at the required frequency.

If the antenna is operating at an industrial scientific and medical (ISM) frequency band such as, for example, 434 MHz or 915 MHz, the height required for efficient antenna operation when placed at ground level might be such that the antenna introduces a trip hazard.

Ground level installation is of interest, for example, when M2M systems are used for utility metering or vehicle monitoring along roadways.

Many of the commercial wireless applications, such as M2M and IoT applications, require an antenna to transmit or receive equally well over wide fields of view since there could be motion involved in the application or a lack of consistency in communication system architecture such that the placement of communication nodes varies from one installation to the next.

In addition, a wide field of view or beam-width of the antenna is generally required for communication systems based on a cellular model, where communication nodes or base stations are positioned in a grid and require a client device or customer device containing an antenna to connect to base stations or nodes in multiple orientation angles.

When a low profile antenna module is required, and the frequency of operation is such that the height or thickness allowed for the antenna module is a fraction of a wavelength, it will be difficult to achieve uniform radiation pattern coverage in a plane of the antenna that is normal to the axis aligned with the dimension of reduced height. Additionally it will be difficult to achieve uniform pattern coverage in the plane normal to the axis aligned with the dimension of reduced height when the polarization of the antenna is required to align with the axis normal to the dimension of reduced height. For example it will be difficult to design an antenna module with vertical polarization referenced to the ground when the antenna is required to be placed on the ground, especially when uniform coverage is required in the plane of the antenna.

For antennas with reduced height requirements at frequencies where the height of the antenna is a fraction of a wavelength a typical characteristic of the antenna will be reduced frequency bandwidth. This reduced bandwidth makes it important to minimize frequency shift of the antenna as the antenna is used or installed on conductive and non-conductive ground planes such as those created by support structures, including but not limited to housings and components of utility meters and the like.

To increase production volumes and to minimize the number of specific antennas needed for applications it is important to design an antenna that will not de-tune in terms of frequency response and impedance properties with respect to a change in the material that the ground plane that the antenna is used with varies, for example, metallic and non-metallic support structures.

SUMMARY

An antenna module is described where uniform radiation pattern coverage is provided in the plane of a low profile antenna radiating element. A polarization that is orthogonal to the plane of the low profile antenna radiating element can be achieved for the radiated field. A ground plate aperture is implemented into the antenna ground plate to minimize frequency shift as the antenna is installed on metallic (conductive) and non-metallic (non-conductive) ground planes of varying sizes. This antenna system technique is applicable fir use in communication systems such as a local Area network (LAN), cellular communication network, and Machine to Machine (M2M).

BRIEF DESCRIPTION OF THE DRAWINGS

These and other aspects are described in the appended details and descriptions, particularly when referenced in conjunction with the following drawings, wherein.

DESCRIPTION OF EMBODIMENTS

Figure 1:
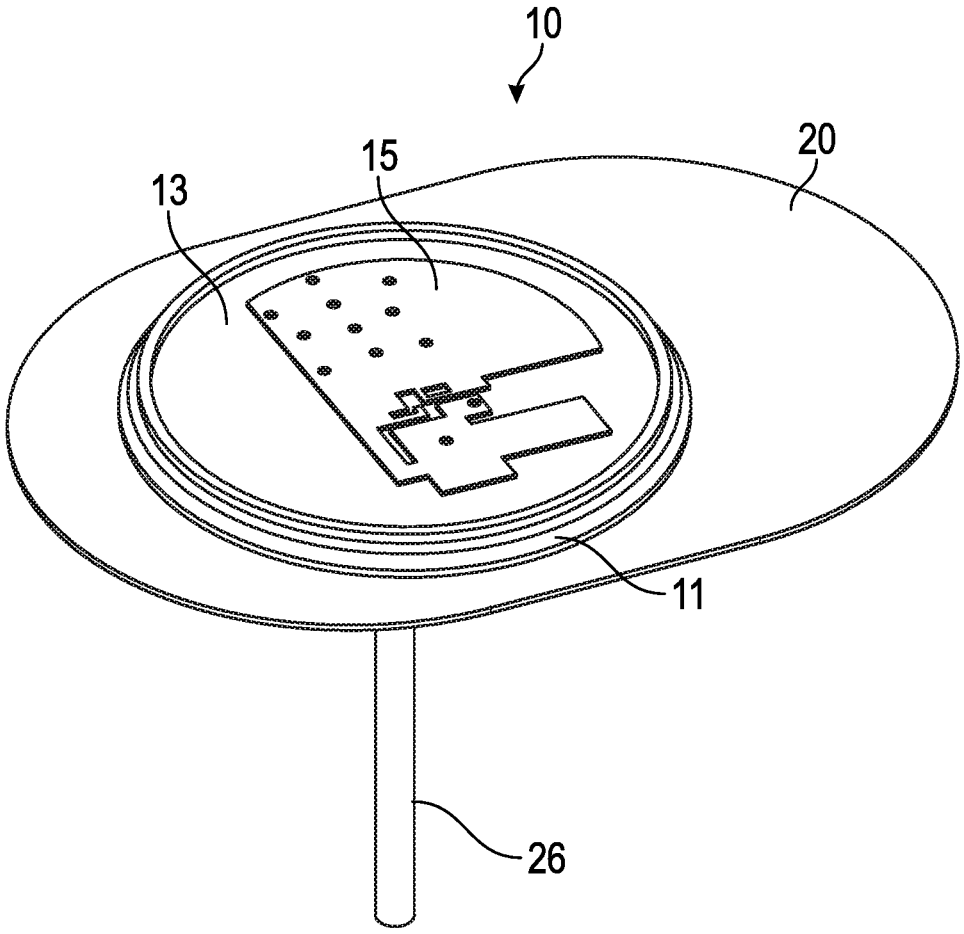
FIG. 1 shows a perspective view of an antenna module in accordance with an illustrated embodiment.

The following describes an antenna module for low profile (reduced height) applications where uniform radiation pattern coverage can be achieved over a wide angular field of view. The polarization can be aligned with the reduced height dimension to provide vertical polarization when the antenna is positioned on the ground.

In particular, an antenna module is described where omni-directional radiation pattern performance is achieved with the dominant polarization being normal to the plane that contains the dominant two dimensions of the antenna in a reduced height form factor. A ground plane aperture is disclosed wherein a frequency response of the antenna does not shift as the antenna is moved from a conductive ground plane to a non-conductive ground plane, for example, integration with a utility meter (water meter) having a plastic support structure or housing vs. one with a metallic support structure or housing. The antenna module as disclosed herein is ideal for applications where vertical polarization is required from low profile antennas place on the ground such that the antenna does not present a trip hazard.

In one embodiment, a first conductor termed the radiating element is positioned above a ground plate, with the ground plate formed from a second conductor. The radiating element takes the form of an area and this area can be shaped as a circle, square, rectangle, or other shape. The radiating element is positioned very close to the ground plate, typically a few hundredths of a wavelength, for example, between one to ten hundredths of a wavelength. The radiating element can be positioned parallel to the ground plate, however this is not a requirement. Offset from the center of the radiating element, a feed connection is made to excite the antenna. The feed connection can be a direct connection using the center conductor of a coaxial cable used to connect the antenna to a transceiver. Alternately a conductor such as a wire or planar element can be used to connect to the radiating element, with this conductor in turn connected to the transmission line. An area or region of the ground plate that the antenna is positioned above is removed such that there is a ground aperture in the ground plate. The location and area of the ground aperture is adjusted such that the frequency response of the antenna radiating element remains fixed when the antenna is positioned on conductive ground planes as well as non-conductive ground planes, such as support structures, housing portions, or other device components.

In another embodiment, the feed connection can be made such that it is a capacitive feed, where the conductor used to couple to the radiating element does not make physical contact. Instead of a wire, a planar conductor in the shape of a rectangle can be used to couple the radiating element to the transceiver. A portion of the planar conductor can be positioned in close proximity to the radiating element such that an electric field is set-up between the planar conductor and the radiating element. The width of the conductor can be selected to increase or decrease the amount of capacitance between the radiating element and conductor. This capacitive coupling feature which eliminates the physical connection of a wire or conductor at the feed location on the radiating element can result in a more reliable antenna configuration when the antenna is subjected to stresses and physical impacts.

In another embodiment, a molded thremoplastic or composite carrier is placed between the antenna radiating element and the ground plate to provide a solid support beneath the entire antenna radiating element. The antenna element is adjusted to compensate for the dielectric constant of the plastic or composite support (thermoplastic carrier). Additionally, the aperture in the ground plate is adjusted to account for the material properties of the plastic or composite carrier. This feature provides an antenna that can support heavy loads when the antenna is installed at ground level and in other configurations.

Now, turning to the drawings, FIG. 1 shows a perspective view of an antenna module 10 in accordance with an illustrated embodiment. The antenna module 10 includes a thermoplastic carrier 11 having a first surface 13 and a second surface (not visible). The second surface is opposite the first surface 13. A first conductor is disposed on the first surface 13 of the thermoplastic carrier 11, the first conductor forming a radiating element 15. A portion of a support structure 20 is shown, the support structure may include a housing or other component of a device, such as a utility meter, for example, a water meter.

Figure 2:
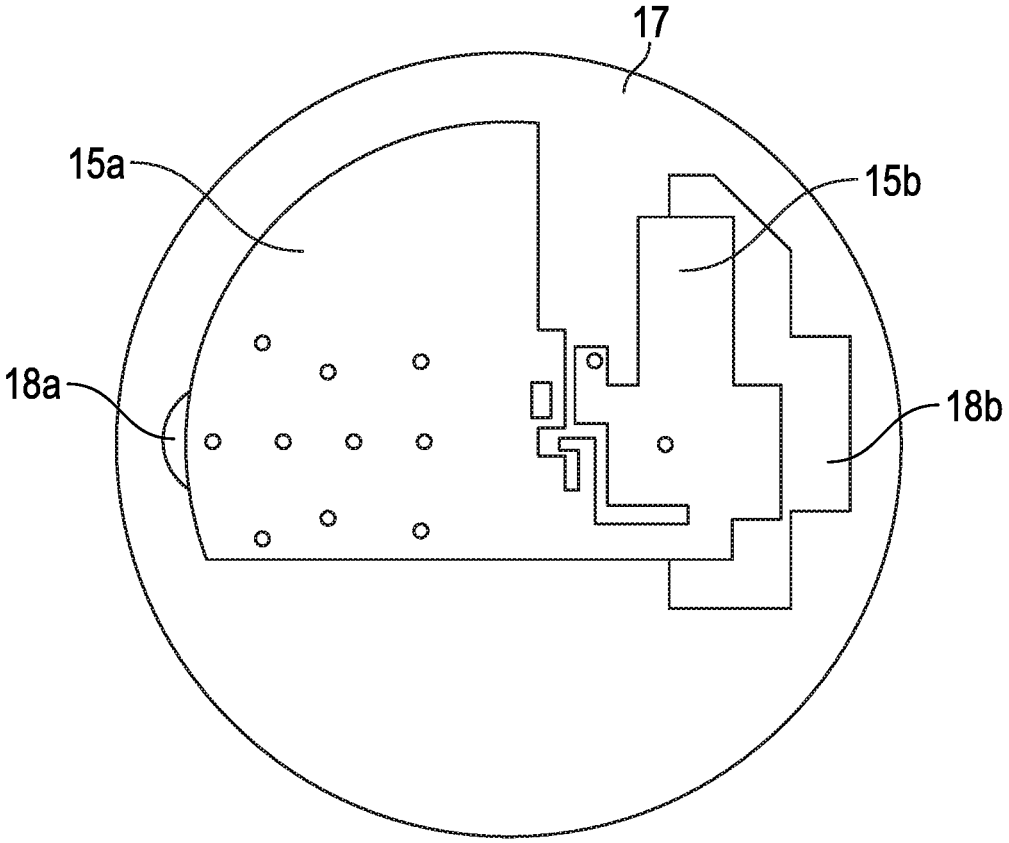
FIG. 2 shows a top view of an antenna radiating element positioned above a ground plate in accordance with the illustrated embodiment, moreover ground plate apertures are illustrated as being disposed at the ground plate at a position beneath portions of the radiating element.

FIG. 2 shows a top view of an antenna radiating element positioned above a ground plate 17 in accordance with the illustrated embodiment. Multiple ground plate apertures 18*a*; 18*b*, respectively, are illustrated as being disposed at the ground plate 17 at a position beneath portions of the radiating element 15*a*; 15*b*.

Figure 3:
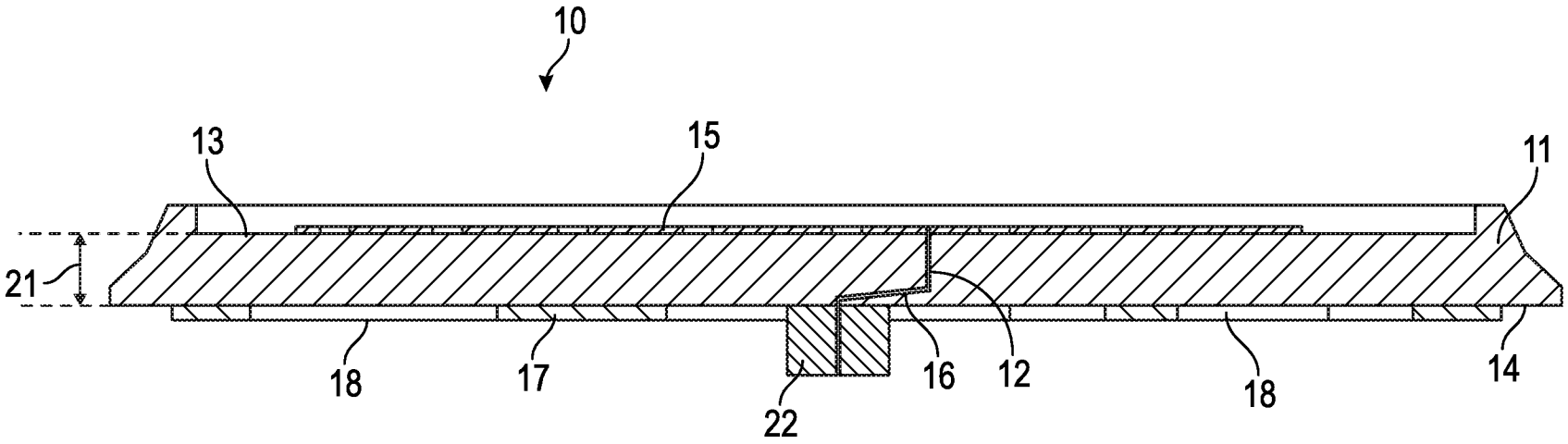
FIG. 3 shows a side view of the antenna module in accordance with the illustrated embodiment, wherein the antenna module is sectioned to further illustrate details thereof.

FIG. 3 shows a side view of the antenna module 10 in accordance with the illustrated embodiment, wherein the antenna module 10 is sectioned to further illustrate details thereof. For instance, the antenna module is shown comprising a thermoplastic carrier 11 having a channel 12 extending from a first surface 13 to a second surface 14 opposite the first surface. A feed conductor 16 is configured to extend along the channel 12 of the thermoplastic carrier 11. An optional coaxial cable connector 22 is shown coupled to the feed conductor. In addition, a first conductor or "radiating element 15" is disposed about the first surface 13 of the carrier 11. whereas second conductor or "ground plate 17" is disposed about the second surface 14 of the carrier 11. At least a portion of the thermoplastic carrier 11 is disposed between the radiating element 15 and the ground plate 17. The ground plate is shown having multiple ground apertures 18. For each ground aperture at least a portion of the ground plate is removed, wherein portions of the radiating element 15 are disposed above the ground apertures 18. The radiating element is separated from the ground plate 17 by a gap 21, wherein the gap is about one to about ten hundredths of a wavelength associated with the antenna module.

Figure 4A:
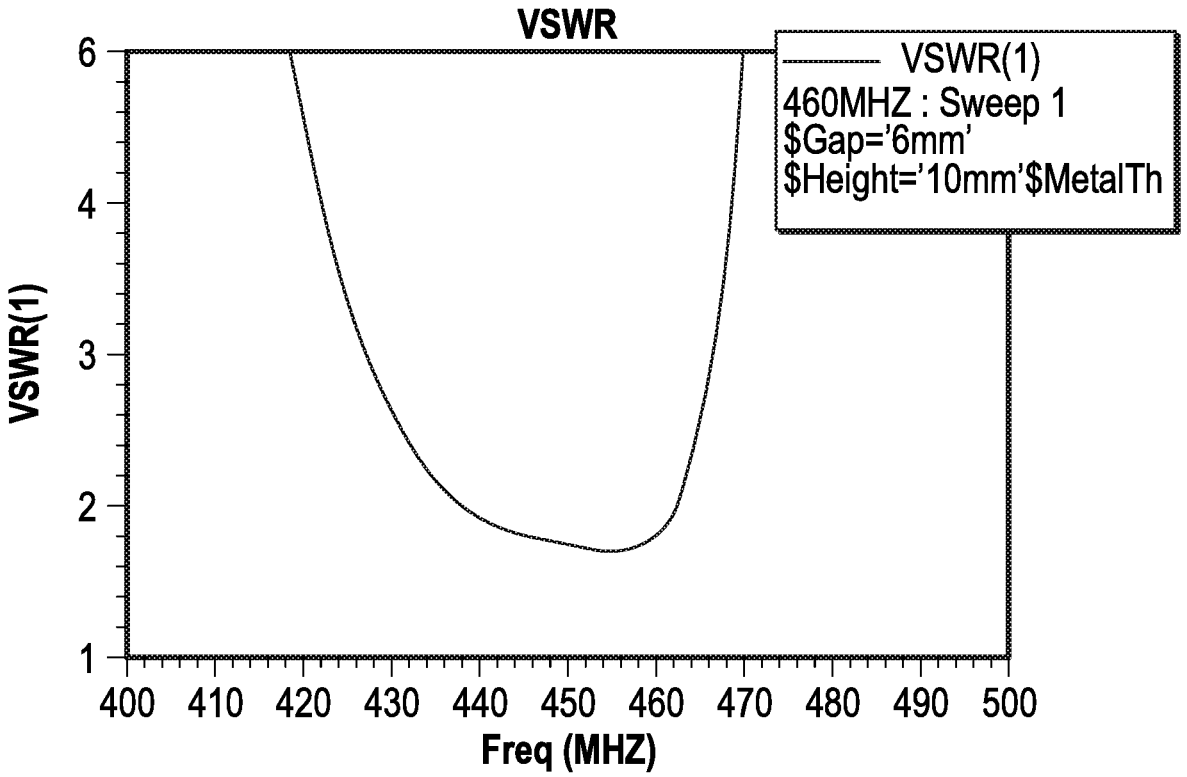
FIG. 4A shows a plot illustrating the voltage standing wave ratio (VSWR) of the antenna module when it is tested in free space.

FIG. 4A shows a plot illustrating the voltage standing wave ratio (VSWR) of the antenna module when it is tested in free space.

Figure 4B:
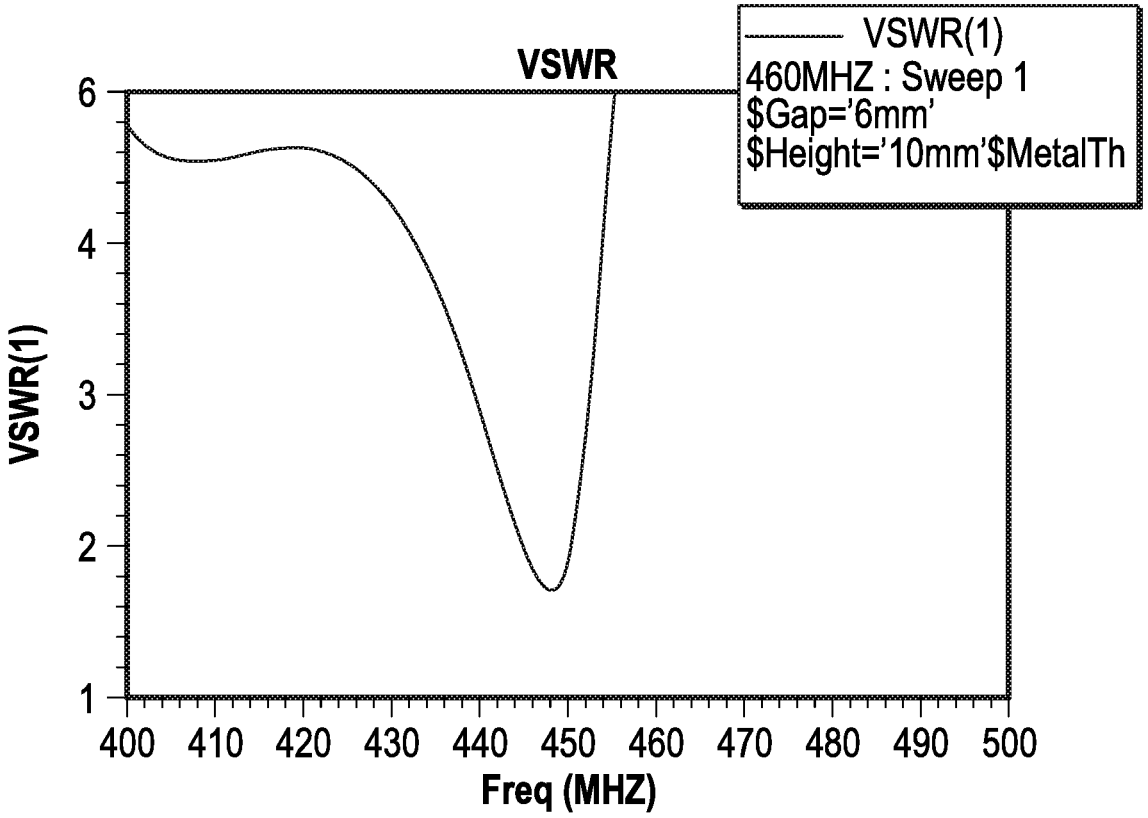
FIG. 4B shows a plot illustrating the voltage standing wave ratio (VSWR) of the antenna module when it is tested on a conductive ground plane.

FIG. 4B shows a plot illustrating the voltage standing wave ratio (VSWR) of the antenna module when it is tested on a conductive ground plane.

Figure 5A:
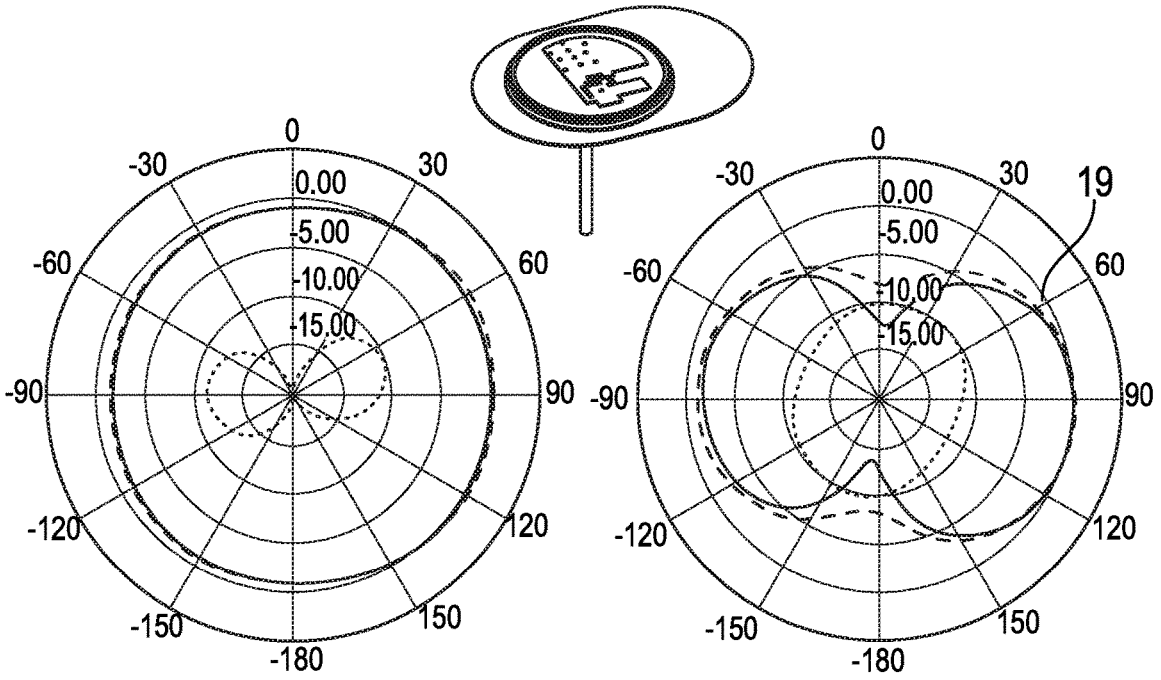
FIG. 5A illustrates a radiation pattern of the antenna module when it is tested in free space.

FIG. 5A illustrates a radiation pattern of the antenna module when it is tested in free space.

Figure 5B:
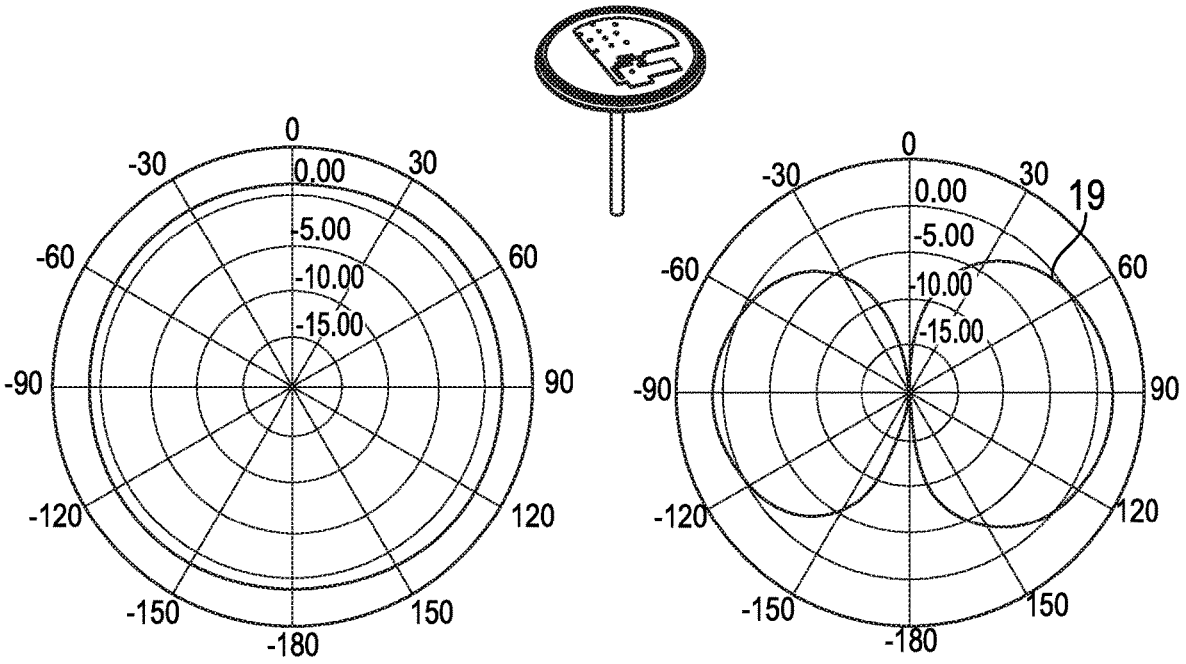
FIG. 5B illustrates a radiation pattern of the antenna module when it is tested on a conductive ground plane.

FIG. 5B illustrates a radiation pattern of the antenna module when it is tested on a conductive ground plane.

With reference to the illustrated embodiment of FIGS. 1-5 herein, the radiating element is configured to provide a first frequency response 19 when the antenna module is coupled to a metallic support structure, and the radiating element is further configured to provide the same first frequency response 19 when the antenna module is coupled to a non-metallic support structure.

Figure 6:
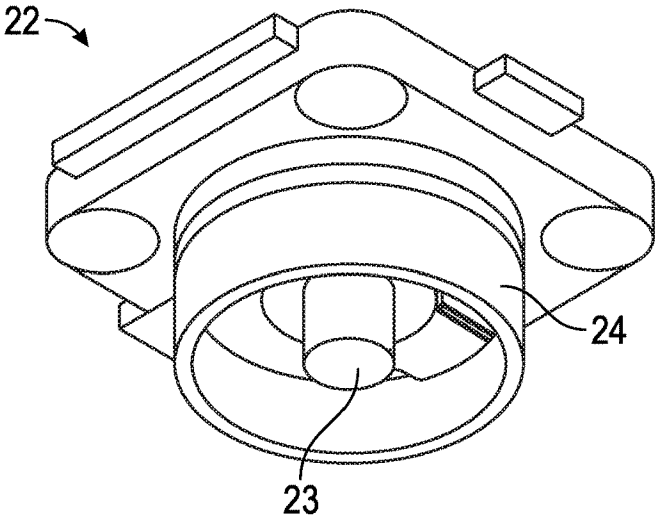
FIG. 6 shows a coaxial cable connector for use in certain embodiments herein.

FIG. 6 shows a coaxial cable connector for use in certain embodiments herein. Any coaxial cable can be implemented; however, for clarity, a center pin 23 and connector body 24 are shown to illustrate one preferred example.

Figure 7:
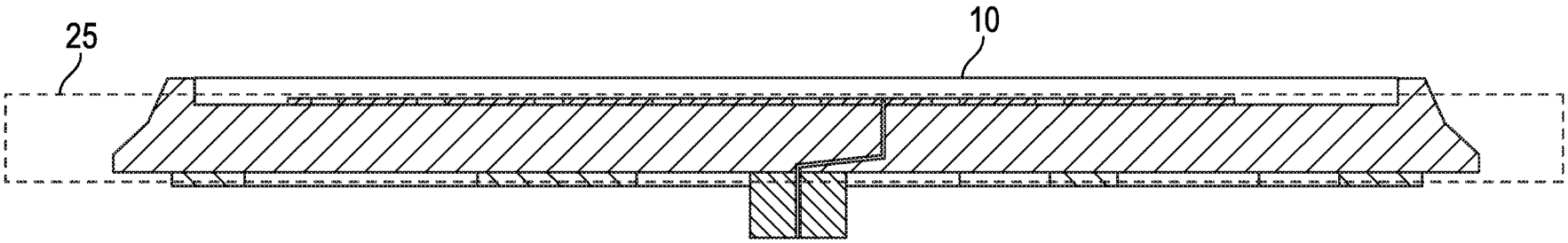
FIG. 7 shows the antenna module having a plane associated therewith.

FIG. 7 shows the antenna module having a plane associated therewith. In this regard, the radiating element and ground plate, and optional thermoplastic carrier, are each contained within a common plane.

Accordingly, it has been disclosed an antenna module comprising: a thermoplastic carrier having a channel extending from a first surface to a second surface thereof, wherein the second surface is opposite the first surface; a first conductor disposed on the first surface of the thermoplastic carrier, the first conductor forming a radiating element coupled to a feed conductor, wherein the feed conductor is configured to extend along the channel of the thermoplastic carrier; a second conductor disposed on the second surface of the plastic carrier, the second conductor forming a ground plate, wherein the first conductor is positioned above the ground plate with at least a portion of the thermoplastic carrier disposed therebetween; further characterized in that: at least a portion of the ground plate is removed to form a ground aperture, wherein at least a portion of the radiating element is at least partially disposed above the ground aperture; wherein the radiating element is configured to provide a first frequency response when the antenna module is coupled to a metallic support structure, and wherein the radiating element is further configured to provide the first frequency response when the antenna module is coupled to a non-metallic support structure.

The antenna module can be configured to couple with a component of a utility meter.

The first conductor can separated from the second conductor by a gap therebetween, wherein the gap is between one and five hundredths of a wavelength of the radiating element.

The antenna module can further include a coaxial cable connector, wherein the feed is coupled to a center pin and the ground plate is coupled to a connector body of the coaxial cable connector.

In another embodiment, it is disclosed an antenna module comprising: a first conductor forming a radiating element, the radiating element being coupled to a feed conductor; a second conductor forming a ground plate, wherein the first conductor is positioned above the ground plate forming a gap therebetween; further characterized in that: at least a portion of the ground plate is removed to form a ground aperture, wherein at least a portion of the radiating element is at least partially disposed above the ground aperture; wherein the radiating element is configured to provide a first frequency response when the antenna module is coupled to a metallic support structure, and wherein the radiating element is further configured to provide the first frequency response when the antenna module is coupled to a non-metallic support structure.

The antenna module can be configured to provide uniform radiation pattern coverage in a plane associated with the radiating element and ground plate.

While certain details and descriptions have been provided herein for the purpose of illustrating to one having skill in the art how to make and use the invention, it should be understood that other features, embodiments and arrangements of the elements herein can be appreciated without departing from the spirit and scope of the invention as-claimed.

Feature List antenna module (10)
thermoplastic carrier (11)
channel (12)
first surface (13)
second surface (14)
first conductor/radiating element (15)
feed conductor (16)
second conductor/ground plate (17)
ground aperture (18)
first frequency response (19)
support structure (20)
gap (21)
coaxial cable connector (22)
center pin (23)
connector body (24)
plane (25)
coaxial cable (26)

What is claimed is:

1. An antenna module comprising:

a first conductor forming a radiating element, the radiating element being coupled to a feed conductor;

a second conductor forming a ground plate, wherein the first conductor is positioned above the ground plate forming a gap therebetween;

further characterized in that:

at least a portion of the ground plate is removed to form a ground aperture, wherein at least a portion of the radiating element is at least partially disposed above the ground aperture;

wherein the radiating element is configured to provide a first frequency response when the antenna module is coupled to a metallic support structure, and wherein the radiating element is further configured to provide the first frequency response when the antenna module is coupled to a non-metallic support structure.

2. The antenna module of claim 1, the antenna module configured to couple with a component of a utility meter.

3. The antenna module of claim 1, wherein the first conductor is separated from the second conductor by a gap therebetween.

4. The antenna module of claim 3, wherein the gap is between one and five hundredths of a wavelength of the radiating element.

5. The antenna module of claim 1, further comprising a coaxial cable connector, wherein the feed is coupled to a center pin and the ground plate is coupled to a connector body of the coaxial cable connector.

6. The antenna module of claim 1, wherein the antenna module is configured to provide uniform radiation pattern coverage in a plane associated with the radiating element and ground plate.

7. An antenna module comprising:

a ground plate having one or more ground apertures; and a radiating element positioned above the ground plate to form a gap, the radiating element at least partially disposed above the one or more ground apertures;

wherein a location and an area of the one or more ground apertures is selected such that a frequency response of the antenna module is fixed when the antenna module is positioned on a conductive support structure and a non-conductive support structure such that the frequency response does not shift as the antenna module is moved from the conductive support structure to the non-conductive support structure.

8. The antenna module of claim 7, wherein the antenna module comprises a low profile antenna such that the gap is a fraction of a wavelength of the radiating element.

9. The antenna module of claim 8, wherein the gap is between one hundredth and five hundredths of the wavelength.

10. The antenna module of claim 7, wherein a dominant polarization of the antenna module is normal to a plane that comprises two dominant dimensions of the antenna module.

11. The antenna module of claim 7, wherein the radiating element comprises an area, and wherein the area comprises at least one of a circle, a square, or a rectangle.

12. The antenna module of claim 7, wherein the radiating element is parallel to the ground plate.

13. The antenna module of claim 7, further comprising a feed conductor coupled to the radiating element.

14. The antenna module of claim 13, wherein the feed conductor is offset from a center of the radiating element.

15. The antenna module of claim 13, wherein the feed conductor comprises a center conductor of a coaxial cable.

16. The antenna module of claim 13, wherein the feed conductor comprises a capacitive feed wherein the feed conductor does not make physical contact with the radiating element.

17. The antenna module of claim 7, further comprising a carrier placed between the radiating element and the ground plate and configured to provide a solid support for the antenna module, wherein the one or more ground apertures are configured to account for material properties of the carrier.

18. The antenna module of claim 17, wherein the carrier comprises at least one of thermoplastic material or composite material.

19. The antenna module of claim 17, further comprising a support structure coupled to the antenna module and comprising the ground plate, wherein the support structure comprises one of the conductive support structure or the non-conductive support structure.

20. The antenna module of claim 19, wherein the support structure comprises a component of a utility meter.

* * * * *